United States Patent [19]

Price, Jr.

[11] 4,262,244

[45] Apr. 14, 1981

[54] CIRCUIT PROVIDING IMPROVED REJECTION TO POWER SUPPLY VARIATIONS TO CURRENT SOURCES DRIVEN THEREFROM

[75] Inventor: John J. Price, Jr., Mesa, Ariz.

[73] Assignee: Motorola, Inc., Schaumburg, Ill.

[21] Appl. No.: 54,192

[22] Filed: Jul. 2, 1979

[51] Int. Cl.[3] ..... G05F 3/20

[52] U.S. Cl. ..... 323/316

[58] Field of Search ..... 307/296 R, 297; 323/1, 323/4, 19, 22 T, 23; 330/296, 297

[56] References Cited

U.S. PATENT DOCUMENTS

| | | | |
|---|---|---|---|
| 3,999,140 | 12/1976 | Radovsky | 330/296 X |
| 4,110,677 | 8/1978 | Boronkay et al. | 323/19 |

*Primary Examiner*—A. D. Pellinen

*Attorney, Agent, or Firm*—Michael D. Bingham

[57] ABSTRACT

A current drive source circuit for providing current drive to a plurality of loads coupled thereto for reducing effects of power supply variations on the loads. The current drive source includes a reference circuit for producing a reference bias potential for biasing a load transistor. An internal current source comprising a split dual-collector PNP transistor provides collector current to the load transistor and also a feedback signal path to the emitter of the load transistor, which emitter electrode is coupled via a resistor to a ground terminal. The output of the current drive source is provided at the base electrode of the split dual-collector transistor.

9 Claims, 2 Drawing Figures

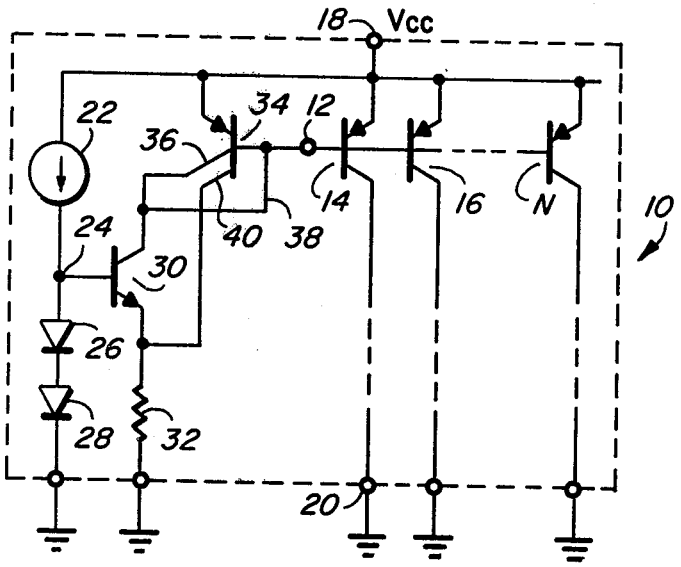
Fig 1
Fig 2
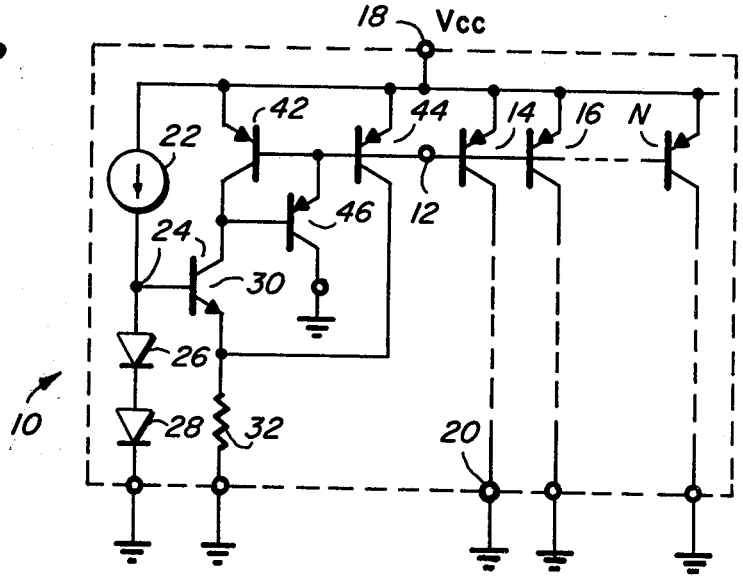

CIRCUIT PROVIDING IMPROVED REJECTION TO POWER SUPPLY VARIATIONS TO CURRENT SOURCES DRIVEN THEREFROM

BACKGROUND OF THE INVENTION

1. Field of the invention

This invention relates to current sources and more particularly to a current drive source for driving a plurality of parallel connected PNP current sources.

2. Description of the Prior Art

In the utilization of integrated circuits it is common to use a plurality of individual parallel connected PNP current sources which provide selective currents to particular circuit portions of the integrated circuit. Typically the base electrodes of the PNP current sources are all driven from the output of a well known Phi/R current drive source. Phi/R current drive sources can be found in integrated operational amplifiers, regulators, comparators and many linear bipolar integrated circuits which use active current sources. For example, the MLM 339 "Quad Single-Supply Comparator", manufactured and sold by MOTOROLA, Inc., incorporates a Phi/R current drive source for driving a string of PNP current sources therefrom.

Although the Phi/R current drive source has a high output impedance, the PNP current sources driven therefrom typically have very poor output impedances. Therefore, if the power supply voltage supplied to both the Phi/R current drive source and the PNP current sources should vary from 5 to 40 volts (which is not uncommon in some applications) it would not be unusual to find that the collector currents of the PNP current sources vary by 100%. This increase in currents will cause greater power dissapation in the integrated circuit which, in turn, causes the integrated chip to heat up. Furthermore, if for instance the integrated circuit includes a comparator, the offset voltage of the comparator is caused to change as the current varies due to the power supply variation. This is undesirous to the user of such an integrated circuit.

Improvement in the output impedance in the PNP current sources can be accomplished by degenerating the emitters by including a series resistor in each. This is not often pratical because of the substantial chip area required by such resistors, or because there is not enough voltage to allow the added voltage drops in the resistors. Therefore, a need exists to provide better rejection to power supply variations without causing substantial chip area to be utilized, or further reducing the voltage which can be supplied to the PNP current sources.

SUMMARY OF THE INVENTION

Accordingly, it is an object of the present invention to provide an improved current drive source for driving loads connected thereto.

It is another object of the present invention to provide a Phi/R type current drive source which provides better rejection to power supply variations.

Still another object of the present invention is to provide a Phi/R current source having negative feedback therein such that the current drive varies inversely with variations in the power supply.

In accordance with the foregoing and other objects there is provided a Phi/R type current drive source comprising a reference circuit for producing a reference voltage at an output therefrom and a load transistor the base electrode of which is connected to the output of the reference circuit. The emitter electrode of the load transistor is coupled to a terminal at which is provided a ground reference potential via a resistor. The improvement comprises an internal current source which provides collector current to the load transistor and which further includes a feedback path connected to the emitter of the load transistor to cause the load transistor collector-to-emitter current to vary inversely with variations in the power supply. An output is provided from the internal current source at which is provided current drive thereat.

BRIEF DESCRIPTION OF THE DRAWINGS

FIG. 1 is a schematic diagram of one embodient of the preferred embodiment of the invention; and FIG. 2 is a schematic diagram of a second embodiment of the invention.

DETAILED DESCRIPTION OF THE INVENTION

Turning to the FIG. 1 there is shown the current drive source of the preferred embodiment of the invention. The dashed outline indicates that the circuitry included therein can be fabricated in monolithic integrated circuit form. The output of current drive source 10 of the present invention is taken at node 12 and as indicated can be utilized to drive the base electrodes of a string of PNP current sources 14, 16 through N. The emitter electrodes of the PNP current sources are all connected to a first power supply terminal 18 at which is supplied power supply voltage VCC. The collector electrodes of the PNP current sources provide current to particular circuit loads connected therewith as indicated by the dash connections. For example, if the integrated circuit is the MLM 339 Quad Comparator previously mentioned, the output of PNP current source 14 may drive a differential comparator connected between the collector thereof and the ground terminal Similarly, the output of PNP current source 16 may be connected to an output load transistor. Generally, the collectors of the PNP current sources are coupled through these circuits to a second power supply terminal, as shown by reference numeral 20, at which a ground reference potential may be provided. Hence, the collectors of the PNP sources are substantially at ground potential since the load circuits coupled therewith provide very little voltage drop.

Current source 22 which is serially connected between terminal 18 and node 24 to diodes 26 and 28 forms therewith a reference voltage circuit for establishing a bias voltage at node 24. The base electrode of NPN load transistor 30 is connected to node 24 and the emitter electrode thereof is connected to ground terminal 20 through resistor 32. Current source 22, diodes 26, 28, transistor 30 and resistor 32 form what is generally known as a Phi/R current drive source. Contemporary Phi/R current source circuits such as the MLM 339 device may include a current mirror arrangement comprising both a PNP transistor and PNP substrate transistor coupled between node 18 and the collector of transistor 30 as is known. This current mirror arrangement sets the emitter-base voltage across the individual PNP current sources and supplies current drive at node 12 to the PNP current sources connected thereat.

The invention comprises providing PNP current mirror to the collector of transistor 30 and also a feedback signal path to the emitter of transistor 30. As shown, PNP dual collector transistor 34 is utilized to provide this function. The emitter of transistor 34 is coupled to terminal 18 with collector 36 being connected both to the collector of transistor 30 and returned, via conductor 38, to the base of this transistor. Collector 40 of transistor 34 provides the feedback signal and is connected to the emitter of transistor 30. The base electrode of transistor 34 is then coupled to output terminal 12.

A problem occurs in prior art circuits if $V_{CC}$ should vary from 5 to 35 volts for instance. If this is to happen, even though the collector current of transistor 30 may remain constant the collector current in the PNP sources 14, 16 through N do not. The collector currents of these PNP sources vary because of all the well known Early effect caused by base width modulation in the PNP current source transistors. It is not uncommon to see a 2:1 variation in the magnitude of currents of the collectors of the PNP current sources as the voltage $V_{CC}$ varies from 5 volts to 35 volts. Hence, not only is power dissipation increased in the integrated circuit but also the quiescent operating condition of the loads connected to the PNP current sources can be caused to be varied. Both of these conditions are undesirable for the user of such integrated circuits. The affect of power supply variation can be reduced by emitter degeneration, i.e., adding a series resistor between the emitters of the PNP current sources and terminal 18. However, the resistors will take up considerable semiconductor chip area which in some instances is impractical. Moreover, the voltage drop across these degeneration resistors might not allow the circuit to operate at the lower voltage range of the power supply voltage.

A solution to the aforementioned problem caused by variations in the power supply voltage is provided by the present invention. The invention consists of splitting the collector of transistor 34 into two components and feeding one current component back to resistor 32. This provides negative feedback such that as $V_{CC}$ rises, collector 40 will provide increased current into resistor 32. The increased current in resistor 32 causes the collector-emitter current of transistor 30 to decrease thereby providing less drive to the PNP current sources. Thus, as the power supply voltage increases, the collector current in transistor 30 decreases whereby the current provided by transistor 34 at terminal 12 also decreases. This retards the base width modulation problem associated with the PNP current sources 14 through N.

It should be noted that the collector to base short, via conductor 38, may be replaced by a substrate PNP 46 as is shown in FIG. 2 to reduce base current error. Transistor 34 is replaced by two PNP transistors 42 and 44. The collector current from transistor 42 provides collector current to transistor 30 with feedback current being supplied at the emitter of transistor 30 from transistor 44. Circuit operation of the embodiment illustrated in FIG. 2 is substantially identical to the operation of the circuit shown in FIG. 1. Additionally, diodes 26 and 28 may be replaced with a zener diode in which case the nature of the current source is changed but the improvement in the output impedance remains effective.

It should be apparent that the aforedescribed embodiments can be mirrored using NPN current sources instead of the PNP devices shown. Furthermore, as is understood, the circuits which have been described can be operated from either a single or dual power supply.

An improvement in power supply rejection, or output impedance, of the PNP current sources of up to 80% has been observed using the present invention. Thus, what has been described is an improved current drive source for driving a string of PNP current sources which can reduce variations in the output currents from these PNP current sources with variations in power supply voltages.

I claim:

1. A monolithic current drive source for providing source drive current to a plurality of current sources driven therefrom, comprising:

first power supply conductor means;

second power supply conductor means;

reference circuit means coupled between said first and second power supply conductor means for providing a substantially constant potential at an output thereof;

a first transistor having a base, collector and emitter, said base being coupled to said output of said reference circuit means;

a second transistor having base, emitter, first and second collectors, said emitter being coupled to said first power supply conductor, said base being the output of the current drive source, said first collector being coupled to said collector of said first transistor, said second collector being coupled to said emitter of said first transistor; and a resistor coupled between said emitter of said first transistor and said second power supply conductor means.

2. A current drive source having an output at which is produced drive current, the drive current being caused to vary in accordance with variations in the power supply voltage supplied to the current drive source to reduce effects of the power supply variations, comprising:

current source means coupled to a terminal at which the power supply voltage is provided having first, second, and feedback outputs, said first output being the output of the current drive source, said current source means being responsive to supply voltage variations for producing a feedback signal at said feedback output which causes the drive current produced at said first output to vary accordingly with the voltage supply variations such that the effect of the voltage supply variations is reduced;

reference circuit means coupled to the supply voltage terminal for producing a substantially constant reference potential at an output thereof;

first electron control means having first, second and control electrodes, said control electrode being coupled to said output of said reference circuit means, said first electrode being coupled to said feedback output, said second electrode being coupled to said second output of said current source means;

first circuit means for coupling said first electrode of said first electron control means to a ground terminal at which is supplied a ground reference potential;

said current source means including second electron control means having first, second, third and control electrodes, said control electrode being coupled to said first output of said current source means, said first electrode being coupled to the supply voltage terminal, said second electrode being said second output and said third electrode being said feedback output; and second circuit means connecting said control electrode of said second electron control means to said second electrode thereof.

3. A current drive source having an output at which is produced drive current, the drive current being caused to vary in accordance with variations in the power supply voltage supplied to the current drive source to reduce effects of the power supply variations, comprising:

current source means coupled to a terminal at which the power supply voltage is provided having first, second, and feedback outputs, said first output being the output of the current drive source, said current source means being responsive to supply voltage variations for producing a feedback signal at said feedback output which causes the drive current produced at said first output to vary accordingly with the voltage supply variations such that the effect of the voltage supply variations is reduced;

reference circuit means coupled to the supply voltage terminal for producing a substantially constant reference potential at an output thereof;

first electron control means having first, second and control electrodes, said control electrode being coupled to said output of said reference circuit means, said first electrode being coupled to said feedback output, said second electrode being coupled to said second output of said current source means;

first circuit means for coupling said first electrode of said first electron control means to a ground terminal at which is supplied a ground reference potential; and said current source means including:

a. second electron control means having first, second and control electrodes, said control electrode being coupled to said first output, said first electrode being coupled to the supply voltage terminal, and said second electrode being said second output; and b. third electron control means having first, second and control electrodes, said control electrodes being said first output, said first electrode being connected to said supply voltage terminal, and said second electrode said feedback output.

4. The current drive source of claim 3 including fourth electron control means having first, second and control electrodes, said control electrode being coupled to said second electrode of said second electron control means, said first electrode being coupled to said control electrode of said second electron control means and said second electrode being coupled to said ground terminal.

5. The current drive source of claim 4 wherein said reference circuit means includes a current source coupled between said supply voltage terminal and said output thereof and additional electron control means coupled between said output and said ground terminal.

6. A current drive source for providing rejection to power supply variations in a load driven therefrom which is provided a source of operating potential from the power supply, comprising:

a reference supply circuit coupled between the power supply and a ground terminal at which is supplied a ground reference potential for providing a substantially constant potential at an output thereof;

a first transistor having base, emitter and collector electrodes, said base electrode being coupled to said output of said reference supply circuit;

a resistor connected between said emitter of said first transistor and said ground terminal;

current source means coupled to the power supply for providing a feedback signal to said first transistor so that the current supplied from said current source means to the load varies inversely with changes in the magnitude of the power supply, said current source having a first output coupled to the output of the current drive source, a second output coupled to the collector electrode of said first transistor, and a feedback output at which is provided said feedback signal that is coupled to the junction of said emitter of said first transistor and said resistor.

7. The current drive source of claim 6 wherein said current source means includes a second transistor having base, emitter, first and second collector electrodes, said emitter electrode being coupled to said source of operating potential, said base electrode being said first output, said first collector electrode being said second output and said second collector being said feedback output.

8. The current drive source of claim 6 wherein said current drive source means includes:

a second transistor having base, emitter and collector electrodes, said emitter electrode being coupled to said source of operating potential, said collector electrode being said second output; and a third transistor having base, emitter and collector electrodes, said emitter electrode being coupled to said source of operating potential, said base electrode being said first output and being coupled to said base electrode of said first transistor, said collector electrode being said feedback output.

9. The current drive source of claim 8 further including a forth transistor having base, emitter and collector electrodes, said emitter electrode being coupled to said base electrode of said second transistor, said base electrode being coupled to said collector electrode of said second transistor, said collector electrode being coupled to said ground terminal.

* * * * *